US008402674B2

(12) United States Patent
Sandy

(10) Patent No.: US 8,402,674 B2
(45) Date of Patent: Mar. 26, 2013

(54) SLIPPERS FOR DANCING, LEISURE, WORK, ATHLETICS AND THE LIKE

(75) Inventor: Marie Sandy, Uxbridge (CA)

(73) Assignee: Big Star Sandy Shoes, Inc., Port Perry, Ontario (CA)

( * ) Notice: Subject to any disclaimer, the term of this patent is extended or adjusted under 35 U.S.C. 154(b) by 576 days.

(21) Appl. No.: 12/654,901

(22) Filed: Jan. 7, 2010

(65) Prior Publication Data

US 2010/0223808 A1 Sep. 9, 2010

(51) Int. Cl.
*A43B 23/02* (2006.01)

(52) U.S. Cl. ..... 36/9 R; 36/45; 2/240

(58) Field of Classification Search ..... 36/9 R, 36/45, 10; 2/240, 239
See application file for complete search history.

(56) References Cited

U.S. PATENT DOCUMENTS

| | | | | |
|---|---|---|---|---|
| 5,784,806 | A * | 7/1998 | Wendt | 36/2 R |
| 5,932,056 | A * | 8/1999 | Mark et al. | 36/47 |
| 6,247,182 | B1 * | 6/2001 | Tasbas | 2/239 |
| 2008/0155731 | A1 * | 7/2008 | Kasahara | 2/240 |

* cited by examiner

*Primary Examiner* — Ted Kavanaugh

(57) ABSTRACT

The slipper has an upper composed of woven material having a warp which extends parallel to the longitudinal axis of the slipper and a weft which extends normal to the weft. The weft has a larger degree of elasticity than that of the warp. The opening for a wearer's foot is defined by a margin which lacks any means for biasing the margin into contact with a wearer's ankle such that minimal pressure is exerted on the ankle by the margin.

14 Claims, 1 Drawing Sheet

Fig.1
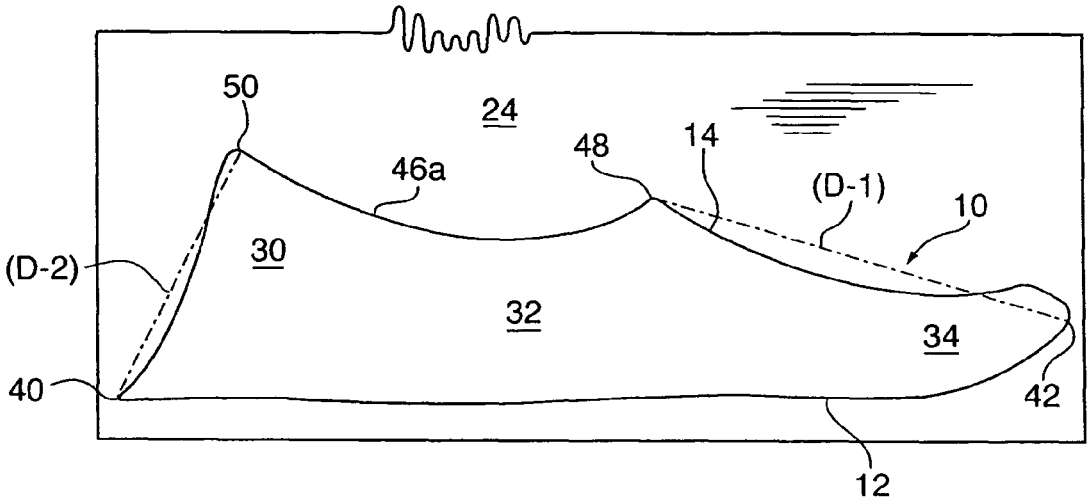
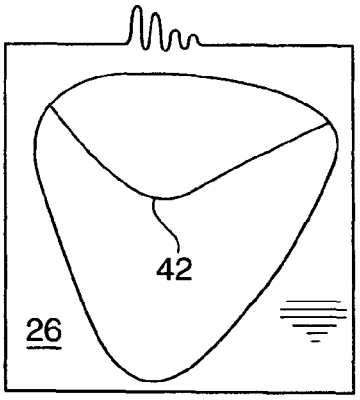
Fig.2
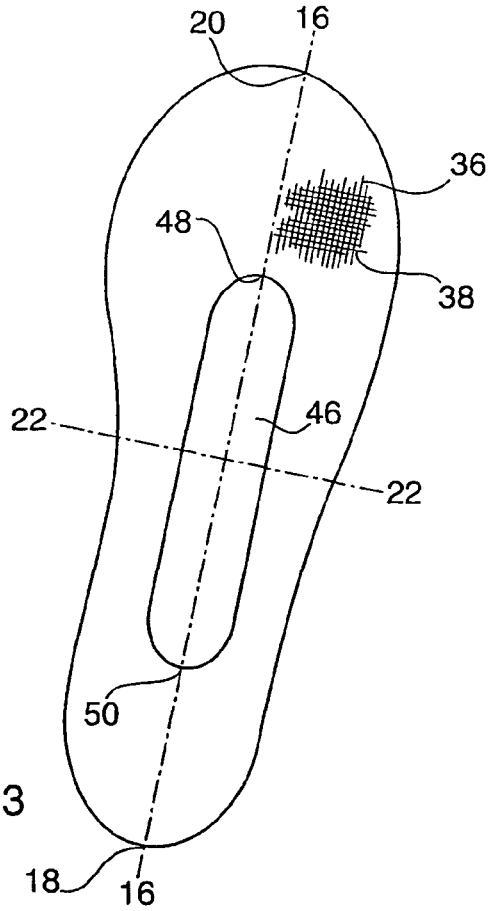
Fig.3

SLIPPERS FOR DANCING, LEISURE, WORK, ATHLETICS AND THE LIKE

FIELD OF THE INVENTION

This invention relates to slippers and more particularly to slippers having uppers which stretch more laterally than longitudinally, which apply little or no pressure on a wearer's ankle and which have toe and heel portions of dimension which vary according to the length of a wearer's foot.

The slipper of my invention is designed to be as comfortable to wear as a sock yet provide the protection to a foot that a conventional slipper provides. The slipper is also designed to minimize pressure on the wearer's ankle while being worn and to be easily put on and taken off a foot.

SUMMARY OF THE INVENTION

Briefly, the slipper of my invention has a longitudinal axis which extends from a wearer's heel to his toe and a transverse axis disposed normal thereto. The axes lie on vertically extending longitudinal and transverse planes disposed normal to each other. The dorsal portion and vamp of the slipper both taper to rear and forward edges, respectively, both of which lie on the longitudinal plane. The upper is composed of woven material having a warp which extends parallel to the longitudinal axis and a weft which extends parallel to the transverse axis. The weft has a larger degree of elasticity than that of the warp. The upper has an opening which receives a wearer's foot and which is defined by a margin which has fore and aft portions which lie on the longitudinal plane. The margin lacks any means for biasing the margin into contact with a wearer's ankle such that inward pressure by the margin on the ankle is minimized.

DESCRIPTION OF THE DRAWING

The slipper of the invention is described with reference to the accompanying drawing in which:

FIG. 1 is an elevation of the slipper from the side;

FIG. 2 is an elevation of the slipper from the front; and

FIG. 3 is a plan view of the slipper.

Like reference characters refer to like parts throughout the description of the drawing.

DESCRIPTION OF PREFERRED EMBODIMENT

With reference to the Figures, the slipper of the invention, generally 10, has a sole 12 and an upper 14. The slipper has a longitudinal axis 16-16 which extends from the heel 18 of the slipper to the toe 20. A transverse axis 22-22 is disposed normal to the longitudinal axis. Both axes lie on vertically extending longitudinal and transverse planes 24, 26, respectively.

The upper has a dorsal portion 30, a medial portion 32 and a vamp 34. The upper is composed of woven material having a warp 36 which extend lengthwise of the slipper and parallel to the longitudinal axis. A weft 38 extends normal to the warp and parallel to the transverse axis.

The dorsal portion and the vamp each taper to rear and forward edges 40, 42 respectively. Both edges lie on the longitudinal plane 24 of the slipper.

The upper has an opening 46 for receipt of a wearer's foot. The edge or margin of the upper 46*a* which defines the opening may have a hem but does not have an elastic strip or any other means for biasing the margin of the opening into contact with the wearer's ankle. The upper margin of the upper accordingly applies no inward pressure on the wearer's ankle or on any other area of the wearer's foot or leg.

Opening 46 is defined, in part, by fore and aft edges 48, 50, respectively. Both edges lie on the longitudinal plane. With reference to FIG. 1, the fore edge 48 is spaced apart from the forward edge 42 by a distance (D-1) which varies according to the length of a wearer's foot. Table 1 sets out the distance D-1 for various sizes of feet.

TABLE 1

| Range of Foot Length (in inches) | D-1 (in inches) |
|---|---|
| </=6.5 | 3.25 |
| >6.5-7.25 | 3.375 |
| >7.25-8.0 | 3.75 |
| >8.0-8.75 | 4.25 |
| >8.75-9.5 | 4.75 |
| >9.5-10.25 | 4.875 |
| >10.25-11 | 5.25 |

The aft edge 50 is spaced apart from the rear edge 40 by a distance (D-2) which also varies according to the length of a wearer's foot. Table 2 sets out the distance D-2 for various sizes of feet.

TABLE 2

| Range of Foot Length (in inches) | D-2 (in inches) |
|---|---|
| 6.5-7.0 | 2.5 |
| >7.0-8.25 | 2.75 |
| >8.25-8.5 | 3.0 |
| >8.5-9.75 | 3.125 |
| >9.75-10.5 | 3.25 |
| >10.5-11 | 4.875 |

The weft of the slipper is more stretchable or has a larger degree of elasticity than that of the warp. Preferably the threads which make up the warp and weft are composed of nylon referred to as Swiss PK 2/75-34.

It will be understood, of course, that modifications can be made in the structure and material of the slipper of the invention without departing from the scope and purview of the invention as defined in the appended claims.

I claim:

1. A slipper having a longitudinal axis which extends from a wearer's heel to his toe and a transverse axis disposed normal thereto, said axes lying on vertically extending longitudinal and transverse planes disposed normal to each other, said slipper having a sole and an upper, said upper having a dorsal portion and a vamp each of which taper to rear and forward edges, respectively, said rear and forward edges both lying on the longitudinal plane, said upper further being composed of woven material having a warp which extends parallel to said longitudinal axis and a weft which extends parallel to said transverse axis, said weft and said warp both having a degree of elasticity, said weft having a larger degree of elasticity than that of said warp, said upper still further having an opening for receipt of a wearer's foot, said opening being defined by a margin which has fore and aft portions which lie on the longitudinal plane and which margin is arranged and constructed to avoid a force which biases said margin against the wearer's ankle such that inward pressure by said margin on said ankle is minimized.

2. The slipper of claim 1 wherein said opening has a fore edge and an aft edge, said fore edge being spaced apart from said forward edge by a distance of 3.25 inches when the length of a wearer's foot is in the range of <1 to 6.5 inches.

3. The slipper of claim 1 wherein said opening has a fore edge and an aft edge, said fore edge being spaced apart from said forward edge by a distance of 3.375 inches when the length of a wearer's foot is in the range of >6.5 to 7.25 inches.

4. The slipper of claim 1 wherein said opening has a fore edge and an aft edge, said fore edge being spaced apart from said forward edge by a distance of 3.75 inches when the length of a wearer's foot is in the range of >7.25 to 8.0 inches.

5. The slipper of claim 1 wherein said opening has a fore edge and an aft edge, said fore edge being spaced apart from said forward edge by a distance of 4.25 inches when the length of a wearer's foot is in the range of >8.0 to 8.75 inches.

6. The slipper of claim 1 wherein said opening has a fore edge and an aft edge, said fore edge being spaced apart from said forward edge by a distance of 4.75 inches when the length of a wearer's foot is in the range of >8.75 to 9.5 inches.

7. The slipper of claim 1 wherein said opening has a fore edge and an aft edge, said fore edge being spaced apart from said forward edge by a distance of 4.875 inches when the length of a wearer's foot is in the range of >9.5 to 10.25 inches.

8. The slipper of claim 1 wherein said opening has a fore edge and an aft edge, said fore edge being spaced apart from said forward edge by a distance of 5.25 inches when the length of a wearer's foot is in the range of >10.25 to 11.0 inches.

9. The slipper of claim 1 wherein said opening has a fore edge and an aft edge, said aft edge being spaced apart from said rear edge by a distance of 2.5 inches when the length of a wearer's foot is in the range of 6.5 to 7.0 inches.

10. The slipper of claim 1 wherein said opening has a fore edge and an aft edge, said aft edge being spaced apart from said rear edge by a distance of 2.75 inches when the length of a wearer's foot is in the range of >7.0 to 8.25 inches.

11. The slipper of claim 1 wherein said opening has a fore edge and an aft edge, said aft edge being spaced apart from said rear edge by a distance of 3.0 inches when the length of a wearer's foot is in the range of >8.25 to 8.5 inches.

12. The slipper of claim 1 wherein said opening has a fore edge and an aft edge, said aft edge being spaced apart from said rear edge by a distance of 3.125 inches when the length of a wearer's foot is in the range of >8.5 to 9.75 inches.

13. The slipper of claim 1 wherein said opening has a fore edge and an aft edge, said aft edge being spaced apart from said rear edge by a distance of 3.25 inches when the length of a wearer's foot is in the range of >9.75 to 10.5 inches.

14. The slipper of claim 1 wherein said opening has a fore edge and an aft edge, said aft edge being spaced apart from said rear edge by a distance of 4.875 inches when the length of a wearer's foot is in the range of >10.5 to 11.0 inches.

* * * * *